US005517007A

United States Patent [19]

Morgan

[11] Patent Number: 5,517,007

[45] Date of Patent: May 14, 1996

[54] THREE VARIABLE REFERENCE CHART AND CALCULATOR

[75] Inventor: Oliver F. Morgan, San Jose, Calif.

[73] Assignees: Sony Corporation, Tokyo, Japan; Sony Electronics Inc., Park Ridge, N.J.

[21] Appl. No.: 305,303

[22] Filed: Sep. 15, 1994

[51] Int. Cl.[6] ..... G06G 1/02

[52] U.S. Cl. ..... 235/70 A; 235/58 R; 235/83; 283/65

[58] Field of Search ..... 235/70 R, 70 A, 235/58 R, 78 R, 88 R, 425, 83; 283/65

[56] References Cited

U.S. PATENT DOCUMENTS

| | | | |
|---|---|---|---|
| 4,149,068 | 4/1979 | Simon | 235/78 R |
| 4,233,768 | 11/1980 | Bromberg | 235/70 R |
| 5,310,996 | 5/1994 | Canal et al. | 235/78 R |

*Primary Examiner*—Thomas M. Dougherty
*Assistant Examiner*—Patrick J. Stanzione
*Attorney, Agent, or Firm*—Ronald P. Kananen

[57] ABSTRACT

Disclosed is a manually operable calculator for determining a fourth value on the basis of three variables. According to one example, the calculator is used to determine the total storage available for a recording medium consisting of several units, such as hard disks or magneto optical disks. Specifically, values for total storage are displayed in response to inputting the capacity of each disk, the number of disks and the data recording rate. According to the invention, the calculator comprises a slide member upon which two rotating wheels are mounted along a common axis of rotation. The slide and wheels each have indicia corresponding to the three variables printed thereon. The indicia on the wheels is selected by rotation while the indicia on the slide is selected by moving the slide within a sleeve having openings formed therein.

21 Claims, 11 Drawing Sheets

THREE VARIABLE REFERENCE CHART AND CALCULATOR

FIELD OF THE INVENTION

This invention relates to a manually operated device for calculating the amount of storage available on recording media such as magnetic disks or magneto optical (MO) disks. More particularly, this invention relates to method and apparatus for manually determining total available storage depending on the bit rate, the disk capacity and the total number of disks.

BACKGROUND OF THE INVENTION

In various applications, recording media, such as "hard" disks or MO disks, are used to store a relatively large, finite amount of data. Often, the total capacity of such recording media is known in terms of the total amount of data available per medium. The total storage is then the product of this amount and the total number of media.

In many applications, it is inconvenient to express total available storage in this manner. For example, in applications relating to the storage of video or audio data, it is much more convenient to express available storage in terms of the available recording time which is a function of the recording rate, the disk capacity, and the total number of disks. That is, it is more convenient to express the total available storage in as the product of the recording rate, the capacity per disk and the total number of disks.

In relatively simple applications in which the recording rate and the total amount of recording space is substantially fixed, expressing available storage in terms of recording time is relatively straightforward. However, in more complicated systems, such as those utilizing a video editing workstation, several different recording rates, disk capacities and total number of disks are available. For example, a particular workstation may have the capability of processing several different video formats which utilize different data rates, such as double speed CDROM, HDTV SDI, or OC-12. Moreover, the video system might be used in conjunction with different types of storage media having different capacities. Further, the number of such media might vary. With such systems, it becomes burdensome for the operator to calculate available storage for different formats and/or different combinations of storage media.

In view of the foregoing, there is a need to provide a more convenient method and apparatus to calculate available storage for a data storage system based on the file size, number of disks and total storage of disks. In particular, there is a need to provide a manually operable calculator to more readily determine available storage.

SUMMARY OF THE INVENTION

Directed to achieving the foregoing objects and aims of the present invention, disclosed is a manually operable device for calculating total storage capacity of recording media comprising: a sleeve having a front surface and a rear surface; a sliding member positioned substantially within the sleeve, the sliding member having a first alignment portion and a second alignment portion; a first set of indicia printed on the sliding member representing a first set of values corresponding to file size or recording rate; a first opening formed in the front surface of the sleeve in alignment with the first set of indicia whereby a value for file size or recording rate is selectively exposed upon moving the sliding member within the sleeve; a first rotary member mounted on the sliding member within the sleeve, the first rotary member having a rotary alignment portion whereby the first rotary member is rotatable to align the rotary alignment portion with the first alignment portion of the sliding member; a second rotary member mounted on the sliding member in axial alignment with the first rotary member; a second set of indicia printed on the first rotary member representing a second set of values corresponding to the total number of recording media, the second set of values being selectively alignable with the second alignment portion of the sliding member whereby a second one of the second set of values is selected; a third set of indicia printed on the second rotary member representing a third set of values corresponding to the storage capacity of each of the recording media; the second rotary member being rotatable to move the third set of indicia proximate the rotary alignment portion of the first rotary member whereby one of the third set of values is selected; and a second opening in the sleeve in alignment with indicia representing predetermined values for the total storage capacity of the recording media, each total storage value corresponding to selected combinations of the first, second and third values wherein each total storage value is the product of selected ones of the first, second and third values.

According to one aspect of the invention the indicia representing the total storage values comprise a plurality of spiral-shaped marks having different colors printed on the second rotary member and extending from the rotational axis of the second rotary member and a corresponding plurality of colored scales of values printed on the front of the sleeve adjacent to the second opening, each spiral-shaped mark having a gradient calculated to indicate total storage time when a point on the spiral-shaped mark is compared to one of the scales of values printed on the sleeve, the gradient being calculated as a function of the first, second and third values.

According to another aspect of the invention, the device further includes additional openings formed on the front surface of the sleeve, the openings selectively exposing additional indicia printed on the sliding member representing predetermined values corresponding to the calculated total storage time. These additional indicia include values for compression ratio, data rate and storage.

According to yet another aspect of the invention, the sleeve has recesses formed in side portions thereof, the recesses exposing peripheral portions of the first and second rotary members whereby the first and second rotary members can be rotated.

According to still another aspect of the invention, the first and second rotary members each have a plurality of indentations formed on at least a portion of the outer peripheral edge thereof, the indentations being formed to accommodate fingers of a user of the device.

DESCRIPTION OF THE INVENTION

Figure 1:
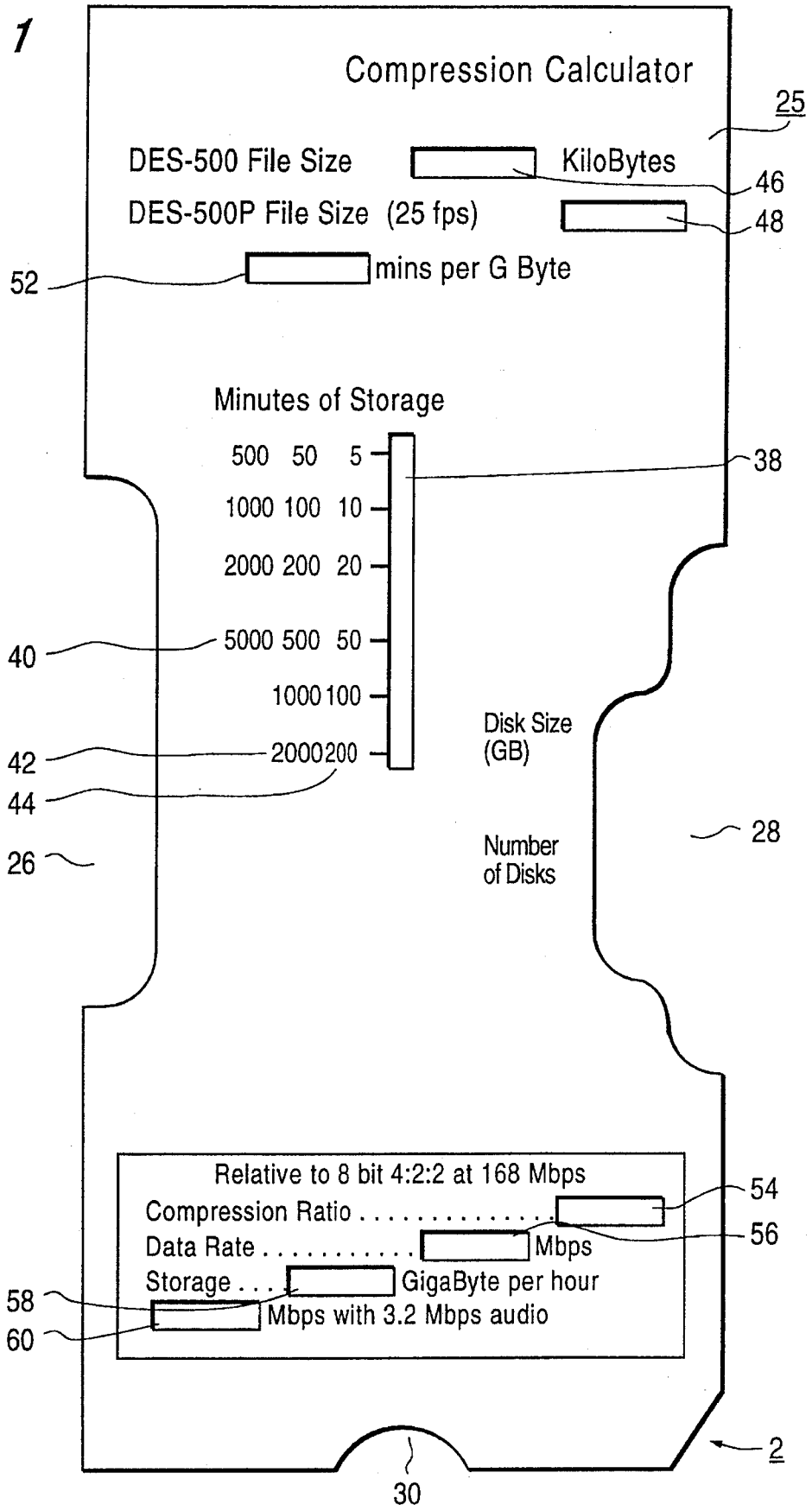
FIG. 1 is front view of a sleeve according to the invention.

FIGS. 1 to 8 show the components of a preferred embodiment of the invention. As described in detail below, this embodiment includes a slide 4 onto which an upper wheel 6 and a lower wheel 8 are attached at a common axis of rotation. The slide 4 and wheels 6, 8 are inserted into a sleeve 25. A complete calculator 1 according to the invention is described with reference to FIGS. 9 to 12.

Figure 2:
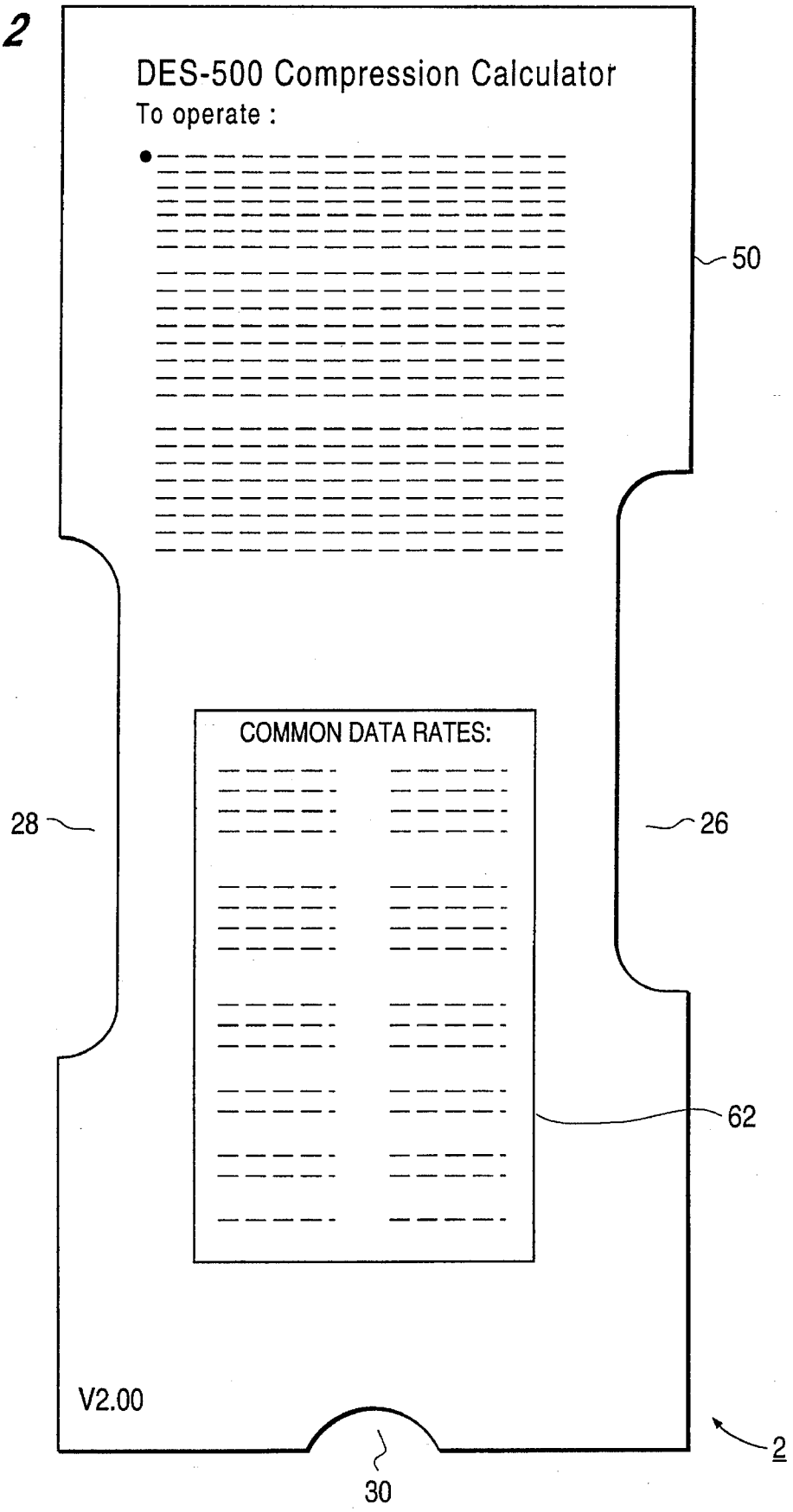
FIG. 2 is a rear view of the sleeve of FIG. 1.
Figure 3:
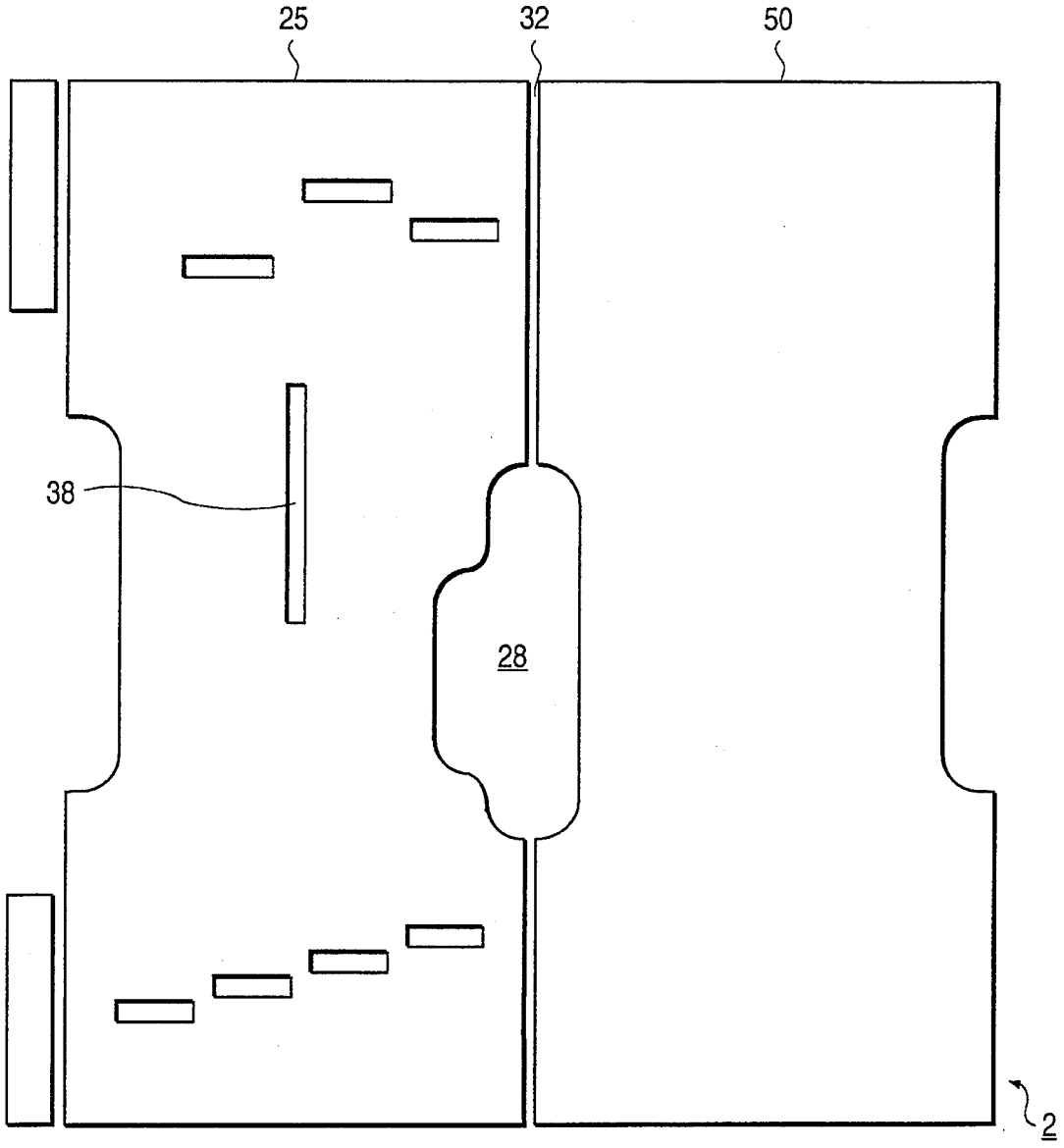
FIG. 3 is a elevational view of a sheet which forms the sleeve of FIGS. 1 and 2.

FIGS. 1 to 3 together show a sleeve 2. In this example, the sleeve 2 consists of a single sheet folded to form a front portion 25 and a rear portion 50. As shown in FIG. 3 the sheet which comprises the sleeve is folded along a crease 32. The front of the sleeve 25 is then joined to the rear of the sleeve 50 by folding tabs 34, 36 underneath the rear portion of the sleeve 50 and adhering the surface of the tabs to the surface of the rear of the sleeve. In this way a sleeve is formed having closed sides and open top and bottom portions.

The sleeve 2 includes a left side recess 26, a right side recess 28 and a bottom recess 30. Formed into the front surface of the sleeve 25 are a series of openings. A first opening 38 forms a narrow rectangular slot in the front surface 25. In this example, the opening 38 is marked by a scale under the caption "Minutes of Storage." Points on the scale are identified by three columns of values 40, 42, 44. Preferably, these columns are identified by color-coding, for example the first column 40 being printed in blue, the second column 42 being printed in red and the third column 44 being printed in black. As shown the columns of values together define a scale ranging from 5 to 5,000 minutes.

The front of the sleeve 25 further includes three openings formed on a top portion thereof and four additional openings formed on a bottom portion. The openings 46, 48, 52, formed on the top portion adjoin three respective captions. The first two openings 46, 48 refer to particular Sony models of video work stations, specifically the DES-500 and the DES500P work stations. The first of these openings 46 identifies in kilobytes a file size, while the second of these openings 48 identifies file size in units of 25 fps. The third of these openings 52 identifies recording rate in minutes per gigabyte (GB). The openings at the bottom portion 54, 56, 58, 60 are used to provide information relating respectively to compressions ratio, data rate and storage.

FIG. 2 shows a rear portion 50 of the sleeve 2. As shown, the rear portion 50 is provided with information describing the use of the calculator according to the invention. This information is explained in more detail below. Also provided in a darker shaded portion 62 are values for data rates commonly used in different video formats, such as DS-1 (T1), RF at 6 MHz, third level E751, D-3 (T3) and so forth.

Figure 4:
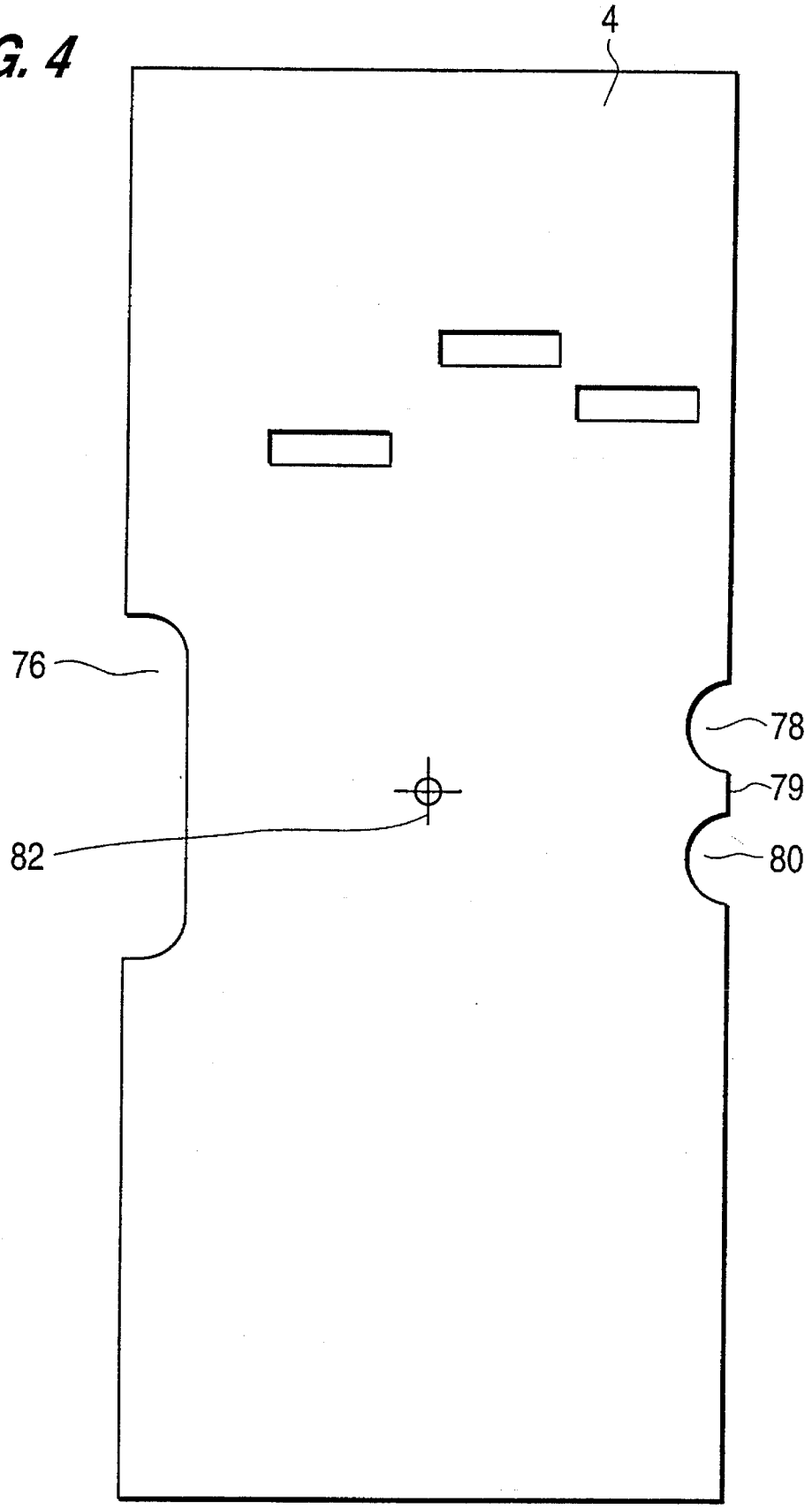
FIG. 4 is a profile of a sliding member according to the invention.

FIG. 4 shows a front view of a slide member 4. As shown the slide member 4 is a thin, substantially rectangular shaped planar member cut to fit snugly in the sleeve 2 between the front portion 25 and the rear portion 50 thereof. More particularly, the slide 4 is proportioned so as to be moveable up and down within the sleeve 2. The slide 4 includes a recess 76 and two semi-circular recess portions 78, 80. The latter portions define an alignment tab 79 therebetween. A cross hair 82 identifies a portion in a central region of the slide 4 upon which the upper wheel 6 and the lower wheel 8 are attached.

Figure 5:
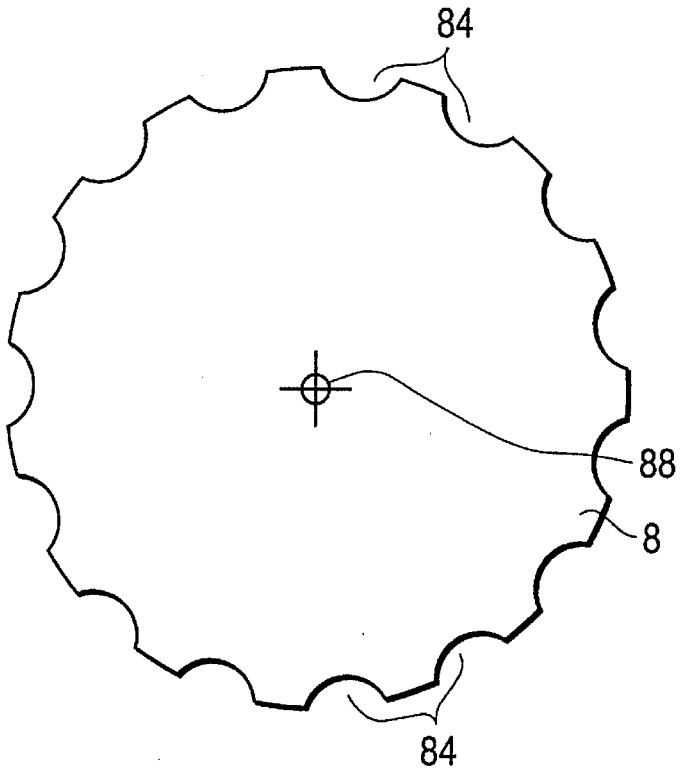
FIG. 5 is a profile view of a lower wheel according to the invention.

A front profile of the lower wheel 8 is shown in FIG. 5. This component comprises a thin, substantially circular, planar member. The outer periphery of the lower wheel 8 has a plurality of recesses 84 formed therein. As explained in more detail below, these recesses 84 form indentations in which a user of the calculator 1 may place his fingers to more easily rotate the wheel. The lower wheel 8 has a central portion identified by a cross hair 86. A rotational axis is formed in this central portion.

Figure 6:
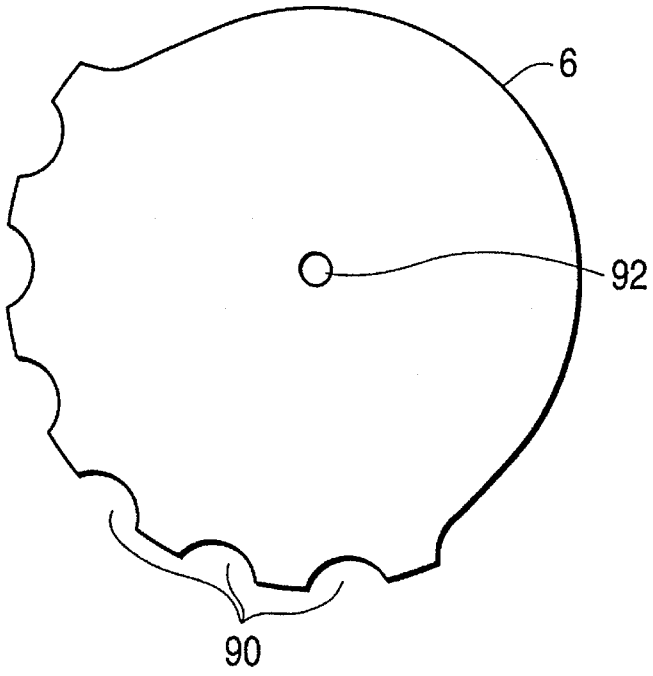
FIG. 6 is a profile view of an upper wheel according to the invention.

FIG. 6 shows a front profile of an upper wheel 6. This member is a substantially circular planar member having indentations 90 formed along an outer peripheral portion thereof. However, a portion of the circular shape which would otherwise define the upper wheel is cut away to reveal a portion of the lower wheel when placed thereover. As with the lower wheel, these recesses facilitate turning the wheel 6 using ones fingers. A hole 92 is formed in the upper wheel 6 to form a rotational axis.

Figure 7:
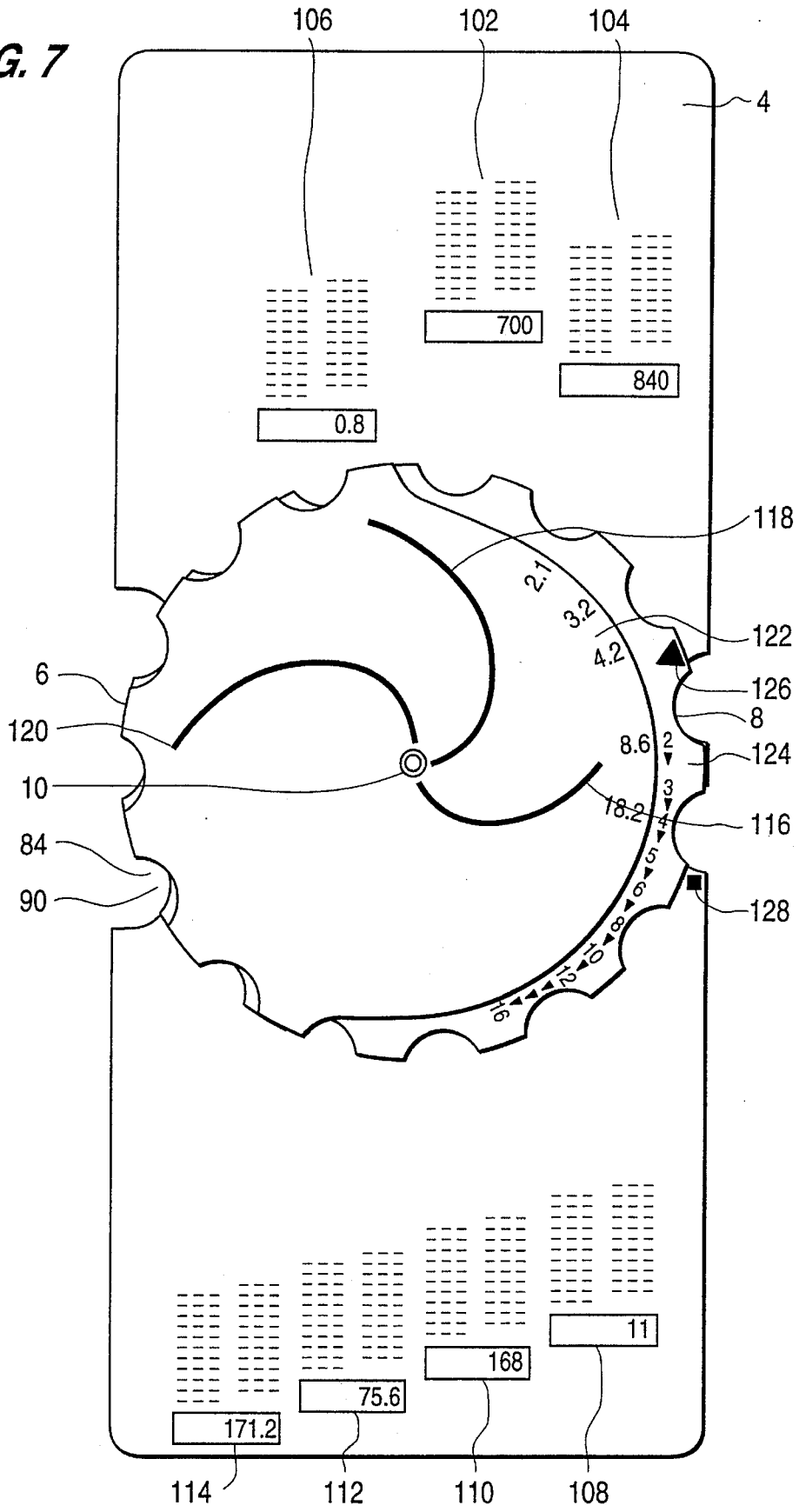
FIG. 7 is a front view of an assembled sliding member, lower wheel and upper wheel, each having printed indicia thereon, according to the invention.

FIG. 7 shows the slide 4 joined together with the lower wheel 8 and the upper wheel 6. These components are connected along the rotational axis of the upper wheel 6 and the lower wheel 8 with a fastener 10. The fastener 10 joins the components and provides a common rotational axis for the upper wheel 6 and the lower wheel 4. As shown, printed indicia are located on the slide 4, the lower wheel 8, and the upper wheel 6. The printed indicia of the lower wheel is visible as a result of a portion of the upper wheel being cut away as mentioned above. The slide 4 includes seven columns of values 102, 104, 106, 108, 110, 112, 114. These columns are positioned to be selectively exposed respectively through openings 46, 48, 52, 54, 56, 58, 60 of the sleeve 2. More specifically, once inserted into the sleeve 2, the slide 4 may be moved so that various values shown in column 102 may be exposed through opening 46. The values at the bottom of each of the columns 102 to 114 are further shaded to indicate to the user that the bottom range of values has been reached. As will be apparent, the recess 30 of the sleeve facilitates movement of the sliding member by exposing a portion of the slide 4 which can be held and moved upward as downward.

As further shown in FIG. 7, the lower wheel 8 has a series of values (numbered 2 through 16 in this example) provided on an outer periphery thereof. In this example, these values correspond to the number of disks. These indicia cooperate with the rectangular shaped mark 128 which is provided on the sliding member 4. More particularly, the lower wheel 8 can be rotated to select one of the values located on the outer periphery of the lower wheel 8 by moving the wheel until the desired value is adjacent the mark 128.

Movement of the lower wheel is facilitated by the indentations 84 which are exposed through the side recess 26 of the sleeve. The alignment mark 128 and the indicia are visible while the lower wheel is in the sleeve by virtue of the side recess 28 of the sleeve. The lower wheel 8 further includes a triangular shape alignment mark 126. This mark enables the user to align the lower wheel with the slide member 4 by rotating the lower wheel until the alignment mark 126 is placed over the tabular portion 79 of the slide 4. In this way the mark 126 and the tabular portion 79 define alignment portions by which the slide 4 and the lower wheel 8 can be aligned. Again, these alignment portions are visible to the user when the slide and the wheels are in the sleeve as a result of recess 28.

The upper wheel 6 includes printed values located along an outer periphery thereof. In the example shown, these values range from 1 to 18.2 and correspond to data medium size. An operator may rotate the upper wheel independently of the lower wheel so that one of these printed values 1 to 18.2 can be selected by aligning the value next to the alignment mark 126 of the lower wheel 8. Again, rotation is facilitated by the indentations 90. Further, the values for the data medium are visible when the upper wheel is in the sleeve 4 by virtue of recess 28.

Further shown on the upper wheel 6 are three spiral shaped marks 116, 118, 120 which extend from the center of the upper wheel 6. Preferably, these marks are color-coded to correspond with the columns of values 40, 42, 44 printed on the front surface of the sleeve 2. For example, the spiral mark 116 might be colored blue while the spiral mark 118 colored red and the spiral mark 120 colored black. As the upper wheel is rotated, the mark appearing through the rectangular opening 38 of the sleeve indicates the value of minutes of storage, the appropriate scale being determined by the color of the mark.

In this example, the values for the total storage time was calculate as a function of three variables—the capacity per disk, the number of disks, and the recording rate. As understood in the art, file size for the DES-500 workstation may be used in calculating the total capacity instead of recording rate (both options are available in the example described herein. Corresponding compression ratios, data rates and storage values were also calculated. Once storage values were calculated as a function of disk size, disk number and file size, the necessary scales and gradient of the spiral marks were calculated. The techniques by which these calculations were performed are summarized in the following tables:

TABLE A

| | Frame Size | | | | Bit rate | | | |
|---|---|---|---|---|---|---|---|---|
| Step 1.25 | actual KB/frame | rounded KB/frame | actual PAL KB/frame | rounded PAL KB/frame | actual Mbps | rounded Mbps | MBps | plus audio +3.2 Mbps |
| 0 | 33.0 | 32 | 39.6 | 40 | 7.9 | 8.0 | 1.0 | 11.1 |
| 1 | 41.3 | 40 | 49.5 | 50 | 9.9 | 10.0 | 1.2 | 13.1 |
| 2 | 51.6 | 50 | 61.9 | 60 | 12.4 | 12.5 | 1.5 | 15.6 |
| 3 | 64.5 | 65 | 77.3 | 80 | 15.5 | 15.5 | 1.9 | 18.7 |
| 4 | 80.6 | 80 | 96.7 | 100 | 19.3 | 19.5 | 2.4 | 22.5 |
| 5 | 100.7 | 100 | 120.8 | 120 | 24.2 | 24.0 | 3.0 | 27.4 |
| 6 | 125.9 | 125 | 151.1 | 150 | 30.2 | 30.0 | 3.8 | 33.4 |
| 7 | 157.4 | 160 | 188.8 | 190 | 37.8 | 38.0 | 4.7 | 41.0 |
| 8 | 196.7 | 200 | 236.0 | 235 | 47.2 | 47.0 | 5.9 | 50.4 |
| 9 | 245.9 | 250 | 295.0 | 295 | 59.0 | 59.0 | 7.4 | 62.2 |
| 10 | 307.3 | 300 | 368.8 | 370 | 73.8 | 74.0 | 9.2 | 77.0 |
| 13.7 | 700.0 | 700 | 840.0 | 840 | 168.0 | 168.0 | 21.0 | 171.2 |
| 0 | 38.4 | 38 | 46.1 | 45 | 9.2 | 9.0 | 1.2 | 12.4 |
| 1 | 48.0 | 48 | 57.6 | 55 | 11.5 | 11.5 | 1.4 | 14.7 |
| 2 | 60.0 | 60 | 72.0 | 70 | 14.4 | 14.5 | 1.8 | 17.6 |
| 3 | 75.0 | 75 | 90.0 | 90 | 18.0 | 18.0 | 2.3 | 21.2 |
| 4 | 93.8 | 95 | 112.5 | 115 | 22.5 | 22.5 | 2.8 | 25.7 |
| 5 | 117.2 | 115 | 140.6 | 140 | 28.1 | 28.0 | 3.5 | 31.3 |
| 6 | 146.5 | 145 | 175.8 | 175 | 35.2 | 35.0 | 4.4 | 38.4 |
| 7 | 183.1 | 185 | 219.7 | 220 | 43.9 | 44.0 | 5.5 | 47.1 |
| 8 | 228.9 | 230 | 274.7 | 275 | 54.9 | 55.0 | 6.9 | 58.1 |
| 9 | 286.1 | 290 | 343.3 | 350 | 68.7 | 68.5 | 8.6 | 71.9 |
| 10 | 357.6 | 350 | 429.2 | 420 | 85.8 | 86.0 | 10.7 | 89.0 |

| | | | Ratio (to 8bit 4:2:2) | | |
|---|---|---|---|---|---|
| Step | Storage | | actual | fr sz rounded | rounded again |
| 1.25 | GB/hour | min/GB | 1.0:1 | 1.0:1 | 1.0:1 |
| 0 | 3.6 | 16.8 | 21.1:1 | 20.6:1 | 21.0:1 |
| 1 | 4.5 | 13.5 | 17.0:1 | 16.5:1 | 17.0:1 |
| 2 | 5.6 | 10.8 | 13.6:1 | 13.2:1 | 13.5:1 |
| 3 | 7.0 | 8.6 | 10.9:1 | 11.0:1 | 11.0:1 |
| 4 | 8.7 | 6.9 | 8.7:1 | 8.6:1 | 9.0:1 |
| 5 | 10.9 | 5.5 | 7.0:1 | 6.9:1 | 7.0:1 |
| 6 | 13.6 | 4.4 | 5.6:1 | 5.5:1 | 5.5:1 |
| 7 | 17.0 | 3.5 | 4.4:1 | 4.5:1 | 4.5:1 |
| 8 | 21.2 | 2.8 | 3.6:1 | 3.6:1 | 3.5:1 |
| 9 | 26.6 | 2.3 | 2.8:1 | 2.9:1 | 2.8:1 |
| 10 | 33.2 | 1.8 | 2.3:1 | 2.2:1 | 2.3:1 |
| 13.7 | 75.6 | 0.8 | 1.0:1 | 1.0:1 | 9.3:1 |
| 0 | 4.1 | 14.5 | 18.2:1 | 18.0:1 | 18.5:1 |
| 1 | 5.2 | 11.6 | 14.6:1 | 14.6:1 | 14.5:1 |
| 2 | 6.5 | 9.3 | 11.7:1 | 11.7:1 | 12.0:1 |
| 3 | 8.1 | 7.4 | 9.3:1 | 9.3:1 | 9.5:1 |
| 4 | 10.1 | 5.9 | 7.5:1 | 7.6:1 | 7.5:1 |
| 5 | 12.7 | 4.7 | 6.0:1 | 5.9:1 | 6.0:1 |

TABLE A-continued

| | | | | | |
|---|---|---|---|---|---|
| 6 | 15.8 | 3.8 | 4.8:1 | 4.7:1 | 5.0:1 |
| 7 | 19.8 | 3.0 | 3.8:1 | 3.9:1 | 4.0:1 |
| 8 | 24.7 | 2.4 | 3.1:1 | 3.1:1 | 3.0:1 |
| 9 | 30.9 | 1.9 | 2.4:1 | 2.5:1 | 2.5:1 |
| 10 | 38.6 | 1.6 | 2.0:1 | 1.9:1 | 2.0:1 |

TABLE B

| | | | | | | | |
|---|---|---|---|---|---|---|---|
| Disk Sizes | | | | | | | |
| Size (GB) | | 1.0 | 2.1 | 4.3 | 8.6 | 18.3 | |
| # of disks | 1 | 1.0 | 2.1 | 4.3 | 8.6 | 18.3 | |
| | 2 | 2.0 | 4.2 | 8.6 | 17.2 | 36.6 | |
| | 3 | 3.0 | 6.3 | 12.9 | 25.8 | 54.9 | |
| | 4 | 4.0 | 8.4 | 17.2 | 34.4 | 73.2 | |
| | 5 | 5.0 | 10.5 | 21.5 | 43.0 | 91.5 | |
| | 6 | 6.0 | 12.6 | 25.8 | 51.6 | 109.8 | |
| | 8 | 8.0 | 16.8 | 34.4 | 68.8 | 146.4 | |
| | 10 | 10.0 | 21.0 | 43.0 | 86.0 | 183.0 | |
| | 12 | 12.0 | 25.2 | 51.6 | 103.2 | 219.6 | |
| | 14 | 14.0 | 29.4 | 60.2 | 120.4 | 256.2 | |
| | 16 | 16.0 | 33.6 | 68.8 | 137.6 | 292.8 | |
| Find the base | | | | | | | |
| | 2.030 | | 1.03 | 1.01 | 0.99 | 1.05 | 3.67E-04 |
| | 2.035 | | 1.03 | 1.01 | 0.98 | 1.05 | 2.77E-04 |
| | 2.040 | | 1.03 | 1.00 | 0.98 | 1.04 | 2.00E-04 |
| | 2.045 | | 1.03 | 1.00 | 0.98 | 1.04 | 1.36E-04 |
| | 2.050 | | 1.02 | 1.00 | 0.98 | 1.04 | 8.48E-05 |
| | 2.055 | | 1.02 | 1.00 | 0.97 | 1.04 | 4.56E-05 |
| | 2.060 | | 1.02 | 0.99 | 0.97 | 1.03 | 1.86E-05 |
| | 2.065 | | 1.02 | 0.99 | 0.97 | 1.03 | 3.53E-06 |
| | 2.070 | | 1.01 | 0.99 | 0.97 | 1.03 | 2.92E-07 |
| | 2.075 | | 1.01 | 0.99 | 0.96 | 1.03 | 8.69E-06 |
| | 2.080 | | 1.01 | 0.98 | 0.96 | 1.02 | 2.86E-05 |
| best | | 2.070 | | | | | |

Angles for disk multiples

| | actual | best |
|---|---|---|
| | 2.100 | 2.070 |
| 1 | 22° | 23° |
| 2 | 36° | 36° |
| 3 | 45° | 46° |
| 4 | 52° | 53° |
| 5 | 58° | 59° |
| 6 | 67° | 69° |
| 8 | 74° | 76° |
| 10 | 80° | 82° |
| 12 | 85° | 87° |
| 14 | 90° | 91° |

Angles for other disk sizes

| size (GB) | angle |
|---|---|
| 3.2 | 38° |
| 6.4 | 61° |

TABLE C

| Projection | Horiz | Vert | Horiz | Vert | Horiz | Vert | Horiz | Vert |
|---|---|---|---|---|---|---|---|---|
| 10 pt | 9.8 | 1.8 | 9.9 | 1.6 | 9.9 | 1.4 | 9.9 | 1.3 |
| 20 pt | 18.7 | 7.2 | 19.0 | 6.3 | 19.2 | 5.6 | 19.3 | 5.1 |
| 30 pt | 25.6 | 15.7 | 26.6 | 13.9 | 27.3 | 12.5 | 27.8 | 11.3 |
| 40 pt | 29.7 | 26.8 | 32.0 | 24.0 | 33.7 | 21.6 | 34.8 | 19.7 |
| 50 pt | 30.4 | 39.7 | 34.7 | 36.0 | 37.8 | 32.7 | 40.0 | 30.0 |
| 60 pt | 27.2 | 53.5 | 34.2 | 49.3 | 39.3 | 45.3 | 43.0 | 41.8 |
| 70 pt | 19.8 | 67.2 | 30.2 | 63.1 | 37.9 | 58.9 | 43.6 | 54.8 |
| 80 pt | 8.2 | 79.6 | 22.6 | 76.7 | 33.3 | 72.8 | 41.3 | 68.5 |
| 90 pt | −7.3 | 89.7 | 11.3 | 89.3 | 25.4 | 86.3 | 36.2 | 82.4 |
| 100 pt | −26.1 | 96.5 | −3.5 | 99.9 | 14.3 | 99.0 | 28.2 | 95.9 |
| 110 pt | −47.7 | 99.1 | −21.4 | 107.9 | 0.1 | 110.0 | 17.3 | 108.6 |

TABLE C-continued

| Projection | Horiz | Vert | Horiz | Vert | Horiz | Vert | Horiz | Vert |
|---|---|---|---|---|---|---|---|---|
| Read out scale | | | | | | | | |
| 1 | 0 pt | | 0 pt | | 0 pt | | 0 pt | |
| 2 | 22 pt | | 25 pt | | 28 pt | | 31 pt | |
| 5 | 50 pt | | 58 pt | | 65 pt | | 72 pt | |
| 10 | 72 pt | | 83 pt | | 93 pt | | 103 pt | |
| 20 | 94 pt | | 107 pt | | 121 pt | | 134 pt | |
| 50 | 123 pt | | 140 pt | | 158 pt | | 175 pt | |
| 100 | 144 pt | | 165 pt | | 186 pt | | 206 pt | |
| 200 | 166 pt | | 190 pt | | 214 pt | | 237 pt | |
| 500 | 195 pt | | 223 pt | | 251 pt | | 279 pt | |
| Offset | 184 pt | | | | | | | |
| 5 | 134 pt | | 126 pt | | 119 pt | | 112 pt | |
| 10 | 112 pt | | 101 pt | | 91 pt | | 81 pt | |
| 20 | 90 pt | | 77 pt | | 63 pt | | 50 pt | |
| 50 | 61 pt | | 44 pt | | 26 pt | | 9 pt | |
| 100 | 40 pt | | 19 pt | | −2 pt | | −22 pt | |
| 200 | 18 pt | | −6 pt | | −30 pt | | −53 pt | |
| 500 | −11 pt | | −39 pt | | −67 pt | | −95 pt | |
| Arbitrary | 98 | | | | | | | |
| | 15.5 | | 11.0 | | 8.4 | | 6.8 | |

TABLE D

| | | | | | |
|---|---|---|---|---|---|
| Pitch | | | | | |
| cog (angle) | 15 | 24° | | | |
| base (rotary multiplier) | | 2.070 | | | |
| step (linear multiplier) | | 1.25 | | | |
| angle for 1 decade | | 76.0° | | | |
| line spacing (pts) | | 7 pt | 8 pt | 9 pt | 10 pt |
| pitch (pts/cog) | | 22.8 | 26.1 | 29.3 | 32.6 |
| # segment each spiral | | 3.9 | 3.5 | 3.1 | 2.8 |
| angular segment each spiral | | 95° | 83° | 74° | 66° |
| second scale multiple | | 1.16 | | | |
| offset to second scale | | 5 pt | 5 pt | 6 pt | 7 pt |
| implies (for 2 scales only): | | to get 4 disk-size steps and 3 #-of-disk-steps, use 8 pt line to get 3 disk-size steps and 3 #-of-disk-steps, use 9 pt line | | | |
| Angles per 10 pts | | | | | |
| 10 pt | | 10.5 | 9.2 | 8.2 | 7.4 |
| 20 pt | | 21.0 | 18.4 | 16.4 | 14.7 |
| 30 pt | | 31.5 | 27.6 | 24.5 | 22.1 |
| 40 pt | | 42.1 | 36.8 | 32.7 | 29.4 |
| 50 pt | | 52.6 | 46.0 | 40.9 | 36.8 |
| 60 pt | | 63.1 | 55.2 | 49.1 | 44.2 |
| 70 pt | | 73.6 | 64.4 | 57.3 | 51.5 |
| 80 pt | | 84.1 | 73.6 | 65.4 | 58.9 |
| 90 pt | | 94.6 | 82.8 | 73.6 | 66.2 |
| 100 pt | | 105.2 | 92.0 | 81.8 | 73.6 |
| 110 pt | | 115.7 | 101.2 | 90.0 | 81.0 |
| Points per angular step | | | | | |
| 1 | 24 pt | 23 pt | 26 pt | 29 pt | 33 pt |
| 2 | 48 pt | 46 pt | 52 pt | 59 pt | 65 pt |
| 3 | 72 pt | 68 pt | 78 pt | 88 pt | 98 pt |
| 4 | 96 pt | 91 pt | 104 pt | 117 pt | 130 pt |
| 5 | 120 pt | 114 pt | 130 pt | 147 pt | 163 pt |
| 6 | 144 pt | 137 pt | 157 pt | 176 pt | 196 pt |
| 7 | 168 pt | 160 pt | 183 pt | 205 pt | 228 pt |
| 8 | 192 pt | 183 pt | 209 pt | 235 pt | 261 pt |

By using the assembled components shown in FIG. 7 in conjunction with the sleeve shown in FIGS. 1 to 3, one can readily calculate the total available storage time for a system based on the disk size, the data rate and the number of disks. An assembled calculator 1 is shown in FIGS. 8 to 12.

Operation of the calculator 1 according to the invention is comprises the following steps. First, using the exposed indentations 84, one rotates the lower wheel 8 until the alignment mark 126 is aligned over the alignment portion 29 of the slide 4. At this point, the alignment mark 126 points to the caption "Disk Size" printed on the sleeve 2.

Second, one preferably holds the calculator in one's left hand and applies pressure to the lower wheel 8 to maintain its position relative to the slide 2. One then rotates the upper wheel until the desired disk size is aligned with the mark 126. Once the disk size has been selected in this manner, one moves the slide upward or downward to select a desired file size in the window 46 or 48 (or equivalently, data rate in window 52). This selection is made while maintaining the relative positions of the two wheels on the slide.

After selection of file size (or data rate), one rotates both disks together until the desired number of disks printed on the lower wheel 8 is moved adjacent to the alignment mark 128 of the slide. At this point, the total available storage is shown through the window 38. The value for available storage is determined from the colored scales 40, 42, 44 adjacent the opening on the sleeve 2.

Figure 8:
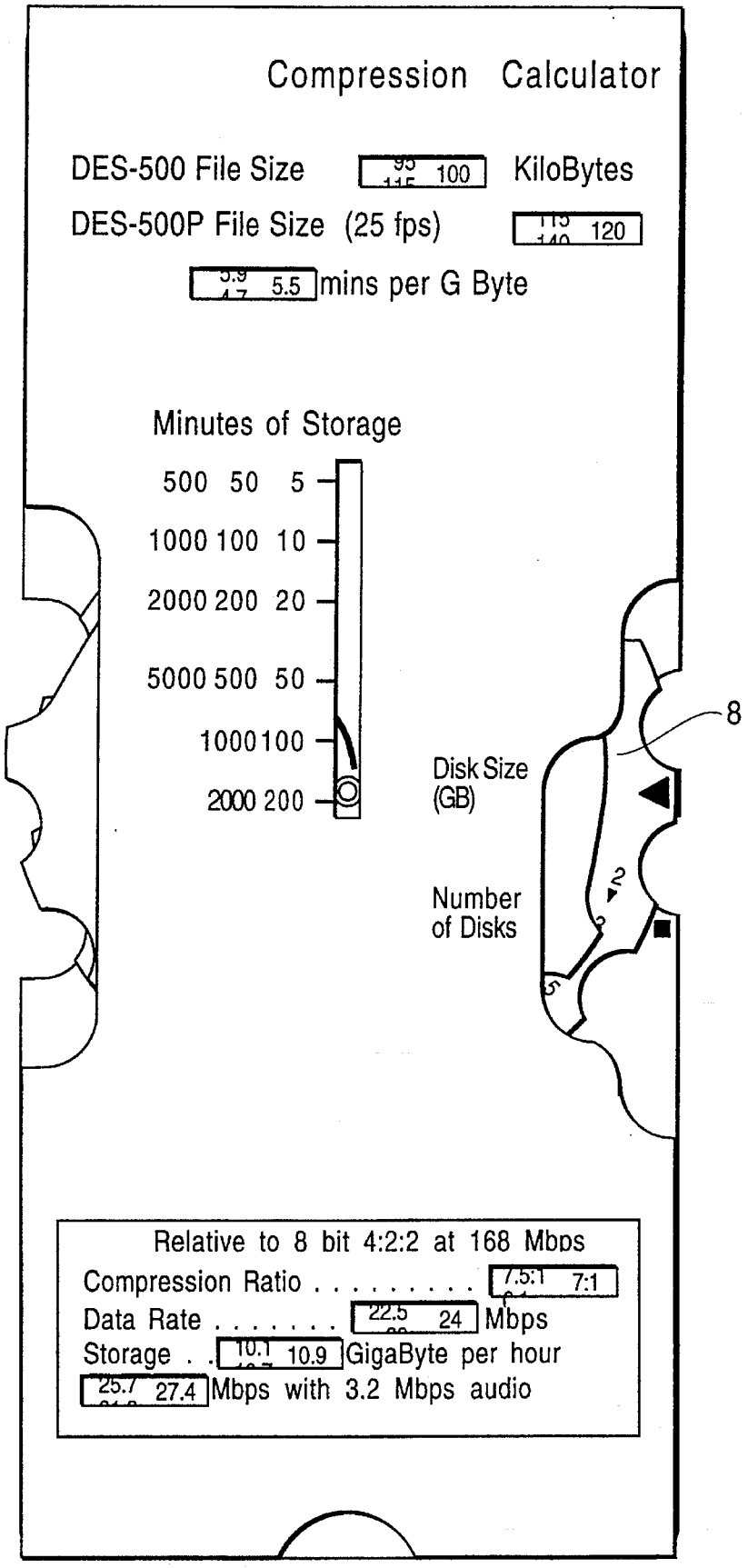
FIGS. 8 to 10 illustrate a first example of the operation of a manually operable calculator according to the invention.
Figure 9:
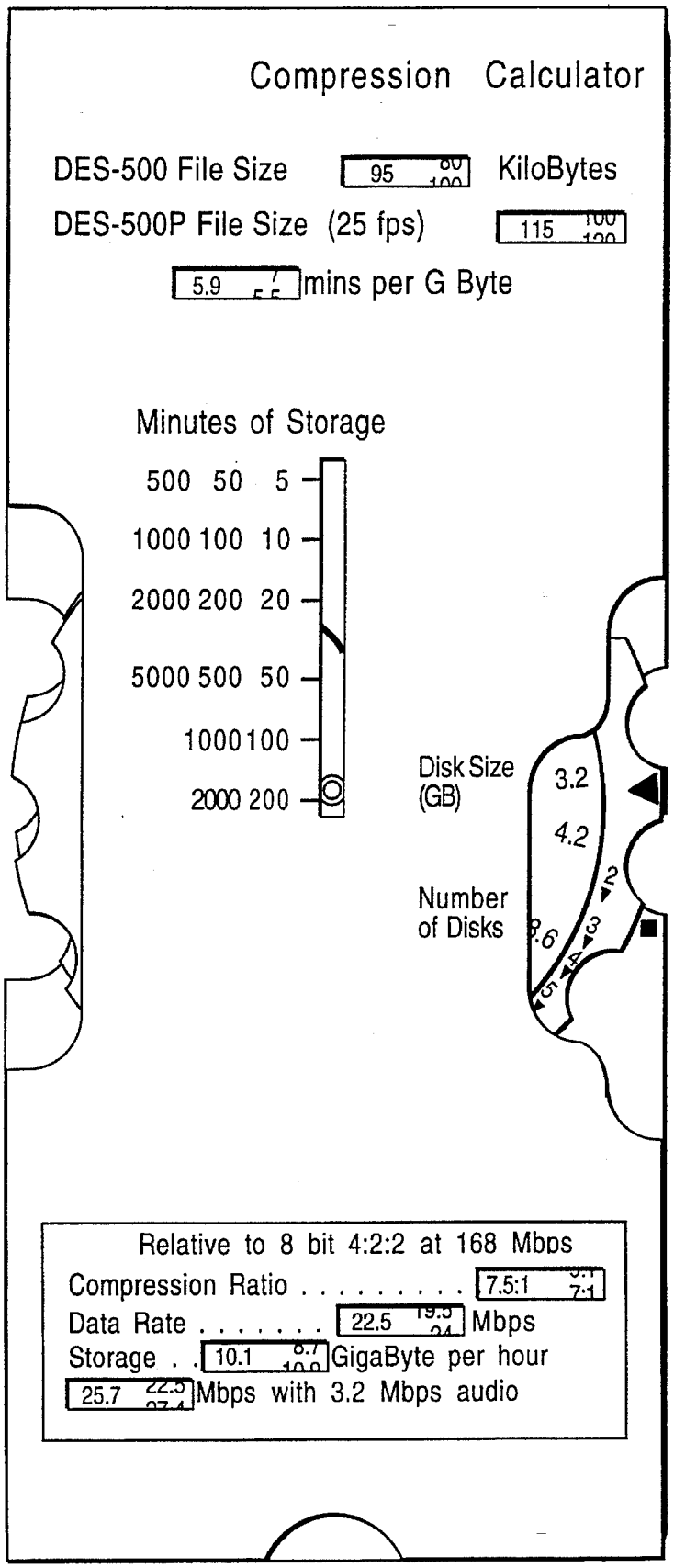
Figure 10:
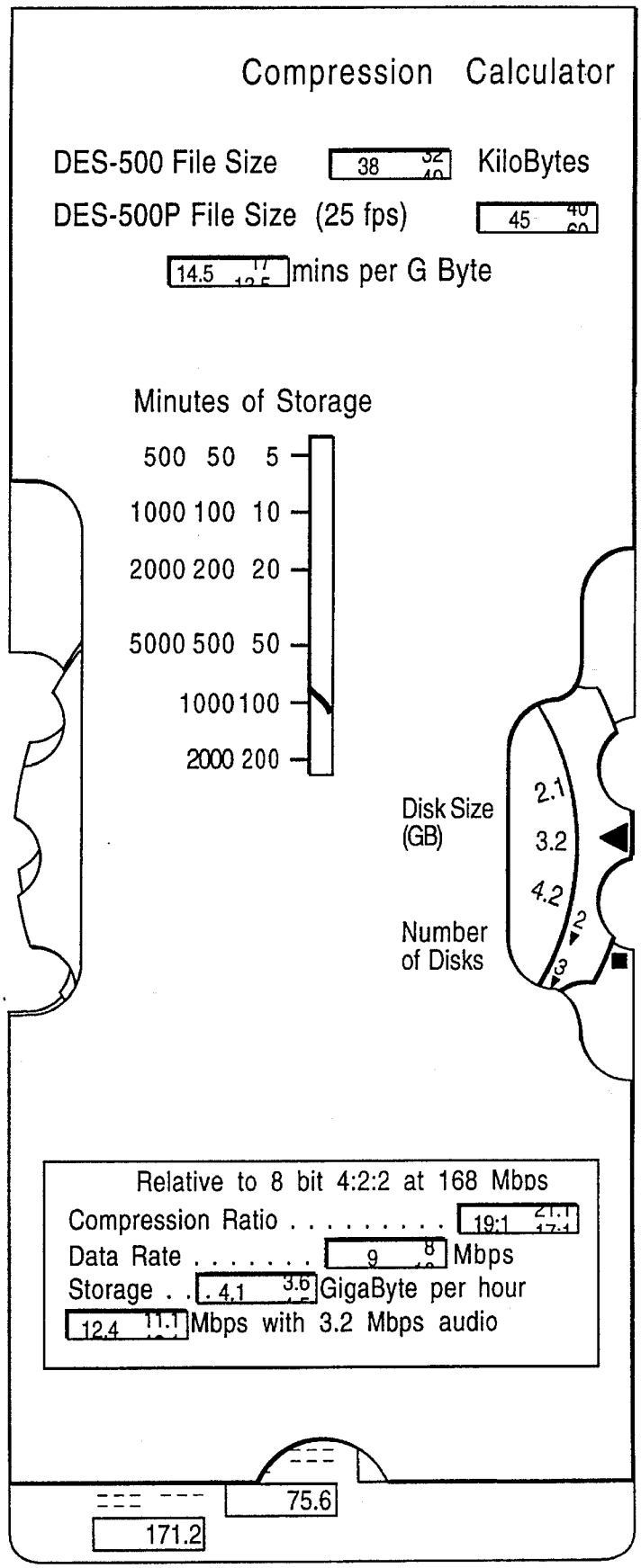

FIGS. 8 to 10 provide two examples of the operation of the calculator according to the invention. FIG. 8 shows a first step in the operation of the calculator. The lower wheel 8 is rotated until the alignment mark 126 is placed over the alignment tab 79 of the sliding member 4. Next, as shown in FIG. 9, the disk size (in gigabytes) is selected by rotating the upper wheel 6 while maintaining the aligned position of the lower wheel 8. In the example shown a disk size of 3.2 GB is selected.

Once the disk size has been selected the file size (or alternatively the recording rate) is selected by moving the slide member upward or downward within the sleeve 2. In the example shown in FIG. 10, a recording rate of 14.5 minutes per gigabyte has been selected. This recording rate corresponds to a file size of 38 kilobytes for a DES 500 workstation or 45×25 FPS for a DES-500p workstation. As shown in the darkened shade portion of the sleeve, these values correspond to a compression ratio of 19:1, a data rate of 9 Mbps and a storage rate of 4.1 gigabytes per hour or 12.4 Mbps.

Figure 11:
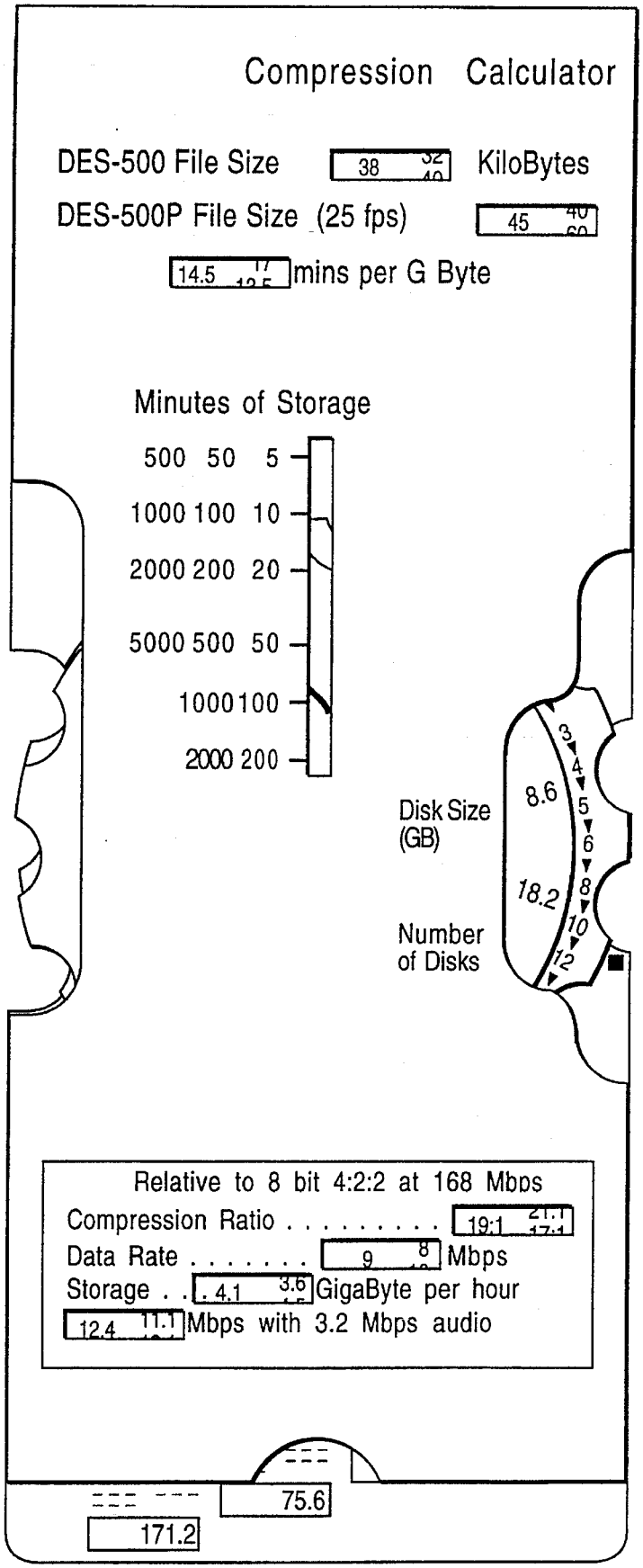
FIGS. 11 and 12 illustrate a second example of the operation of a manually operable calculator according to the invention.

Once the recording rate has been selected, the number of disks is then selected by the user, as illustrated in FIG. 11. In order to select the number of disks, the user rotates both wheels 6 and 8 together until the desired number of disks is located adjacent to the mark 128 located on the sliding member 4. As both disks are rotated, the red spiral mark 118 becomes aligned with the minutes of storage scale through the rectangular opening 38. In this example, upon selection of a disk size of 3.2 GB and a file size of 14.5 minutes per gigabyte, a disk number of 10 was input by rotation of the wheels. As shown in FIG. 11, these three variables correspond to approximately 350 minutes of storage, as indicated by the red column of values 42 printed on the front surface of the sleeve 2.

Figure 12:
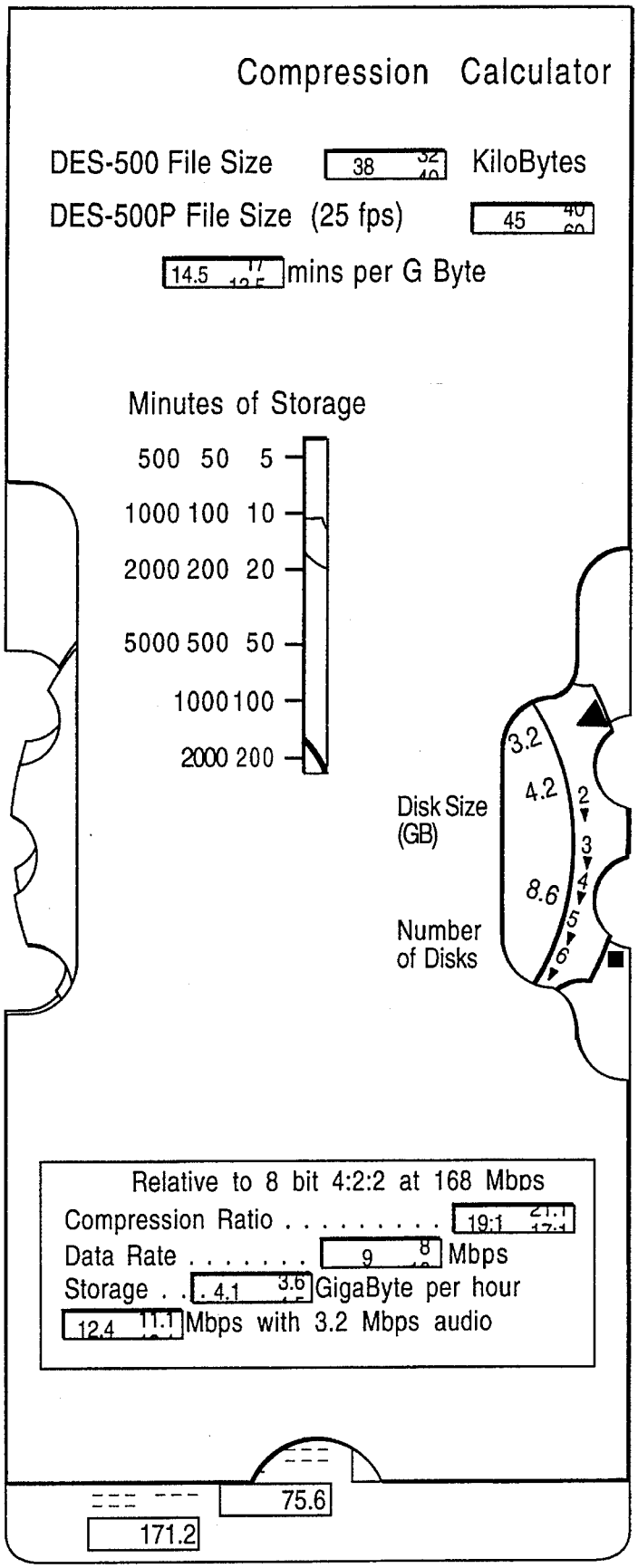

FIG. 12 shows a second example in which the same disk size (3.2 GB) and recording rate (14.5 min/GB) has been selected, but a different number of disks. Specifically, instead of ten disks being selected as in FIG. 11, a disk number of five was selected. This selection causes the black spiral mark 120 to appear within the opening 38 of the sleeve. As shown, this black mark corresponds to a value of 175 minutes of storage as shown in the column of values 44 which is printed in black on the front surface of the sleeve.

As shown in the foregoing examples, the present invention provides a convenient tool for calculating the total amount of storage available in a recording system such as a video workstation. The use of two rotating members in conjunction with a sliding member provides a means to select three variables in order to determine a fixed value. The use of three scales each color-coded enables a large range of values for storage to be displayed. For example, the use of three spiral marks provides a scale from 5 to 200 minutes (shown in black), a range from 50 to 2,000 minutes (shown in red) and a range of 500 to 5,000 minutes (shown in blue). While the example shown above was specifically created for use with the DES-500 video workstation, it will be apparent to those skilled in the art that the invention can be adapted for use with other recording systems.

Another advantage of the calculator according to the present invention is its relatively inexpensive construction. For example, the calculator shown in the drawings was constructed of a light cardboard material covered with printed, shaded sheets. The shaded sheets were separately prepared and then applied to each component with an adhesive.

The foregoing is a detailed description of the preferred embodiment of the invention. The scope of the invention, however, is not so limited. Various alternatives will be readily apparent to one of ordinary skill in the art. The invention is only limited by the claims appended hereto.

What is claimed is:

1. A calculator comprising:

a sleeve having a first and a second opening formed therein;

a sliding member positioned substantially within the sleeve, said sliding member having a first set of indicia printed on a surface thereof representing a first set of values for a first variable, said first set of indicia being such that one of said first set of values is selectively exposed through said first opening by moving said sliding member in said sleeve whereby a value for said first variable is selected;

a first rotary member mounted on the sliding member within the sleeve, the first rotary member being rotatable to align the first rotary member in a fixed position relative to said sliding member, said first rotary member having a second set of indicia printed on a surface thereof representing a second set of values for a second variable, the second set of values being selectively alignable with respect to said sliding member whereby a second one of the second set of values is selected;

a second rotary member mounted on the sliding member in axial alignment with the first rotary member, said second rotary member having a third set of indicia printed on a surface thereof representing a third set of values for a third variable, the third set of values being selectively alignable with respect to said first rotary member whereby one of the third set of values is selected; and a fourth set of indicia representing a fourth set of predetermined values calculated as a function of said first, second and third variables, said predetermined values being observable through said second opening of said sleeve upon selection of a values for said first, second and third variables.

2. The calculator according to claim 1 wherein the fourth set of indicia comprise a spiral-shaped mark printed on the second rotary member and extending from the rotational axis thereof, and a scale of values printed on the front of the sleeve adjacent to the second opening, the spiral-shaped mark having a gradient calculated to indicate a value when a point on the spiral-shaped mark is compared to the scale of values printed on the sleeve, the gradient being calculated as a function of the selected values for said first, second and third variables.

3. The calculator according to claim 1 wherein the fourth set of indicia comprise a plurality of spiral-shaped marks having different colors printed on the second rotary member and extending from the rotational axis of the second rotary member and a corresponding plurality of colored scales of values printed on the front of the sleeve adjacent to the second opening, each spiral-shaped mark having a gradient calculated to indicate a value when a point on the spiral-shaped mark is compared to one of the scales of values printed on the sleeve, the gradient being calculated as a function of the selected values for said first, second and third variables.

4. The calculator according to claim 1 wherein the calculator selectively displays total storage available on a plurality of digital storage devices, wherein the first variable represents a data recording rate, the second variable represents the number of said storage devices and the third variable represents the storage capacity of each storage device, whereby the total amount of storage available is the product of said first, second and third variable.

5. The calculator according to claim 4 further comprising additional openings formed on the front surface of the sleeve, the openings selectively exposing additional indicia representing values for compression ratio, data rate and storage which are dependent on the first, second and third variables.

6. The calculator according to claim 4 wherein the data storage devices comprise magnetic hard disks or magneto optical disks.

7. The calculator according to claim 6 wherein the data storage devices store video data which is available to an editing workstation.

8. The calculator according to claim 1 wherein both the sliding member and the sleeve have recesses formed in side portions thereof, the recesses exposing peripheral portions of the first and second rotary members.

9. The calculator according to claim 8 wherein said first and second rotary members each have a plurality of indentations formed on at least a portion of the outer peripheral edge thereof, the indentations being formed to accommodate fingers of a user of the device.

10. A manually operable device for calculating total storage capacity of recording media comprising:

a sleeve having a front surface and a rear surface;

a sliding member positioned substantially within the sleeve, the sliding member having a first alignment portion and a second alignment portion;

a first set of indicia printed on the sliding member representing a first set of values corresponding to file size or recording rate;

a first opening formed in the front surface of the sleeve in alignment with the first set of indicia whereby a value for file size or recording rate is selectively exposed upon moving the sliding member within the sleeve;

a first rotary member mounted on the sliding member within the sleeve, the first rotary member having a rotary alignment portion whereby the first rotary member is rotatable to align the rotary alignment portion with the first alignment portion of the sliding member;

a second rotary member mounted on the sliding member in axial alignment with the first rotary member;

a second set of indicia printed on the first rotary member representing a second set of values corresponding to the total number of recording media, the second set of values being selectively alignable with the second alignment portion of the sliding member whereby a second one of the second set of values is selected;

a third set of indicia printed on the second rotary member representing a third set of values corresponding to the storage capacity of each of the recording media, the second rotary member being rotatable to move the third set of indicia proximate the rotary alignment portion of the first rotary member whereby one of the third set of values is selected; and a second opening in the sleeve in alignment with indicia representing predetermined values for the total storage capacity of the recording media, each total storage value corresponding to selected combinations of the first, second and third values wherein each total storage value is the product of selected ones of the first, second and third values.

11. A manually operable device for calculating total storage capacity of recording media according to claim 10 wherein said sliding member includes an end portion extending from the sleeve for moving the sliding member within the sleeve.

12. A manually operable device for calculating total storage capacity of recording media according to claim 10 wherein the indicia representing the total storage values comprise a spiral-shaped mark printed on the second rotary member and extending from the rotational axis thereof, and a scale of values printed on the front of the sleeve adjacent to the second opening, the spiral-shaped mark having a gradient calculated to indicate total storage time when a point on the spiral-shaped mark is compared to the scale of values printed on the sleeve, the gradient being calculated as a function of the first, second and third values.

13. A manually operable device for calculating total storage capacity of recording media according to claim 10 wherein the indicia representing the total storage values comprise a plurality of spiral-shaped marks having different colors printed on the second rotary member and extending from the rotational axis of the second rotary member and a corresponding plurality of colored scales of values printed on the front of the sleeve adjacent to the second opening, each spiral-shaped mark having a gradient calculated to indicate total storage time when a point on the spiral-shaped mark is compared to one of the scales of values printed on the sleeve, the gradient being calculated as a function of the first, second and third values.

14. A manually operable device for calculating total storage capacity of recording media according to claim 10 further comprising additional openings formed on the front surface of the sleeve, the openings selectively exposing additional indicia printed on the sliding member representing predetermined values corresponding to the calculated total storage time.

15. A manually operable device for calculating total storage capacity of recording media according to claim 14 wherein the additional indicia including values for compression ratio, data rate and storage.

16. A manually operable device for calculating total storage capacity of recording media according to claim 10 wherein the data storage media comprise a plurality of magnetic hard disks or magneto optical disks.

17. A manually operable device for calculating total storage capacity of recording media according to claim 10 wherein the sleeve has recesses formed in side portions thereof, the recesses exposing peripheral portions of the first and second rotary members whereby the first and second rotary members can be rotated.

18. A manually operable device for calculating total storage capacity of recording media according to claim 17 wherein said first and second rotary members each have a plurality of indentations formed on at least a portion of the outer peripheral edge thereof, the indentations being formed to accommodate fingers of a user of the device.

19. A method of manually determining the total storage available on a data storage media made up of a plurality of storage disks comprising the steps of:

calculating a set of values corresponding to total storage time dependent on a first range of disk sizes, a second range of data recording rates, and a third range of total numbers of disks;

providing a sleeve having a front surface and a rear surface, the front surface having a first opening and a second opening formed therein;

providing a sliding member positioned substantially within the sleeve, the sliding member having a first alignment portion and a second alignment portion, the sliding member having a first set of indicia printed thereon in a position which is exposable through the first opening and a second set of indicia printed thereon in a position which is exposable through the second opening, wherein the first set of indicia corresponds to the second range of data recording rates and the second set of indicia corresponds to the calculated values of total storage time;

providing a first rotary member mounted in the sliding member within the sleeve, the first rotary member having a rotary alignment portion and having a third set of indicia printed thereon which correspond to the third range of total numbers of disks;

providing a second rotary member mounted on the sliding member in axial alignment with the first rotary member, the second rotary member having a fourth set of indicia printed thereon which correspond to the first range of disk sizes;

rotating the first rotary member until the rotary alignment portion thereof is adjacent to the first alignment portion of the sliding member;

selecting a value for disk size from the first range by rotating the second rotary member while maintaining the first rotary member in alignment with the sliding member;

subsequent to selecting disk size, moving the sliding member until a desired recording rate from the second range is exposed through the first opening;

subsequent to selecting disk size and recording rate, selecting a value for the number of disks from the third range by simultaneously rotating both the first and second rotary members while maintaining the position of the sliding member; and observing the value of the storage time indicated through the second opening.

20. The method according to claim 19 wherein the indicia representing the total storage values comprise a spiral-shaped mark printed on the second rotary member and extending from the rotational axis thereof, and a scale of values printed on the front of the sleeve adjacent to the second opening, the spiral-shaped mark having a gradient calculated to indicate total storage time when a point on the spiral-shaped mark is compared to the scale of values printed on the sleeve, the gradient being calculated as a function of the first, second and third values.

21. The method according to claim 19 wherein the indicia representing the total storage values comprise a plurality of spiral-shaped marks having different colors printed on the second rotary member and extending from the rotational axis of the second rotary member and a corresponding plurality of colored scales of values printed on the front of the sleeve adjacent to the second opening, each spiral-shaped mark having a gradient calculated to indicate total storage time when a point on the spiral-shaped mark is compared to one of the scales of values printed on the sleeve, the gradient being calculated as a function of the first, second and third values.

* * * * *